United States Patent [19]

Peekna

[11] Patent Number: 4,676,161

[45] Date of Patent: Jun. 30, 1987

[54] MAGNETIC CYLINDERS WITH IMAGE PLATE OR BLANKET FOR OFFSET PRINTING

[75] Inventor: Andres Peekna, Hinsdale, Ill.

[73] Assignee: R. R. Donnelley & Sons Company, Chicago, Ill.

[21] Appl. No.: 763,128

[22] Filed: Aug. 6, 1985

Related U.S. Application Data

[63] Continuation-in-part of Ser. No. 610,044, May 14, 1984, Pat. No. 4,625,928.

[51] Int. Cl.[4] ..... B41F 27/02; H01F 7/20

[52] U.S. Cl. ..... 101/378; 101/382 MV; 335/285

[58] Field of Search ..... 101/382 MV, 395, 415.1, 101/DIG. 12, 378; 335/295, 285

[56] References Cited

U.S. PATENT DOCUMENTS

| | | | |
|---|---|---|---|
| 2,621,592 | 12/1952 | Faeber | 101/415.1 |
| 2,884,572 | 4/1959 | Maynard | 335/295 |
| 3,231,789 | 1/1966 | Engelsted | 335/295 |
| 3,347,162 | 10/1967 | Braznell et al. | 101/395 X |
| 3,496,866 | 2/1970 | Nystrand | 101/378 |
| 3,810,555 | 5/1974 | Wright | 335/285 |
| 3,824,926 | 7/1974 | Fukuyama | 101/382 MV X |
| 4,040,351 | 8/1977 | Faust | 101/382 MV |

*Primary Examiner*—Clifford D. Crowder

*Attorney, Agent, or Firm*—Wood, Dalton, Phillips, Mason & Rowe

[57] ABSTRACT

Magnetic cylinders with an image plate or an offset blanket carrier plate have annular pole pieces and magnets which maximize either the resistance of the plate to peel-off or the attractive force intensity with a nominal displacement of the plate from the cylinder for typical operating conditions. The plates are precurved, preferably with a radius slightly less than the cylinder radius.

27 Claims, 23 Drawing Figures

FIG. 1
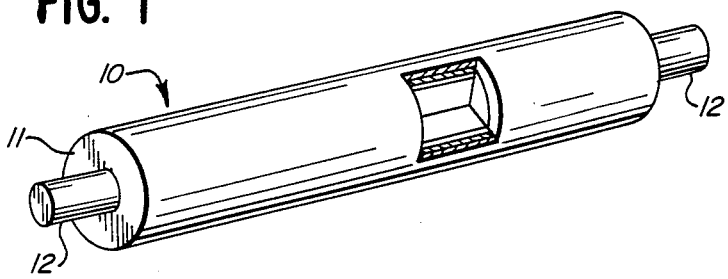
FIG. 2
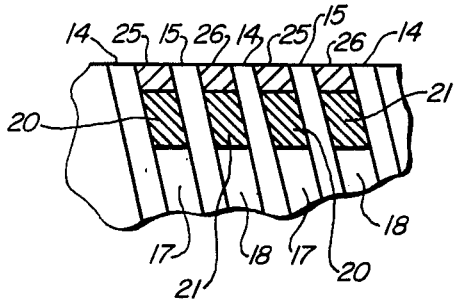
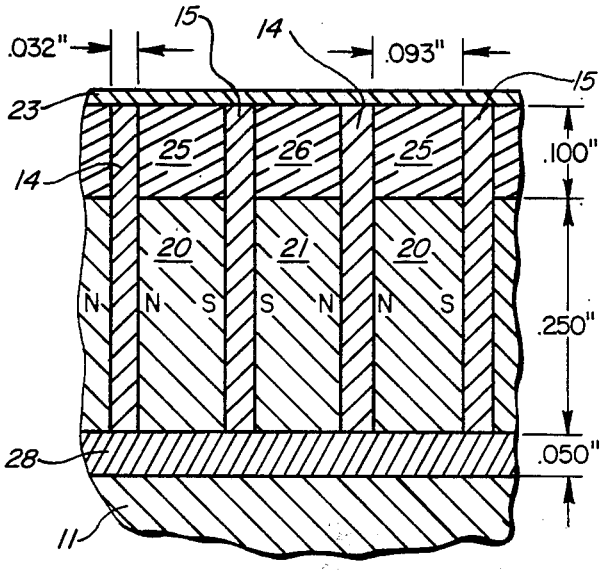
FIG. 3
PRIOR ART
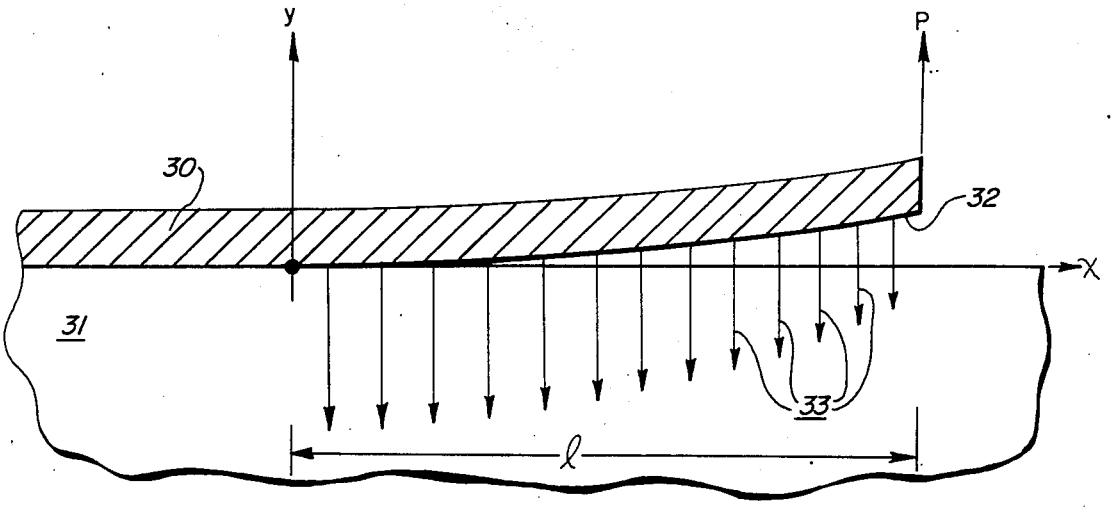
FIG. 4

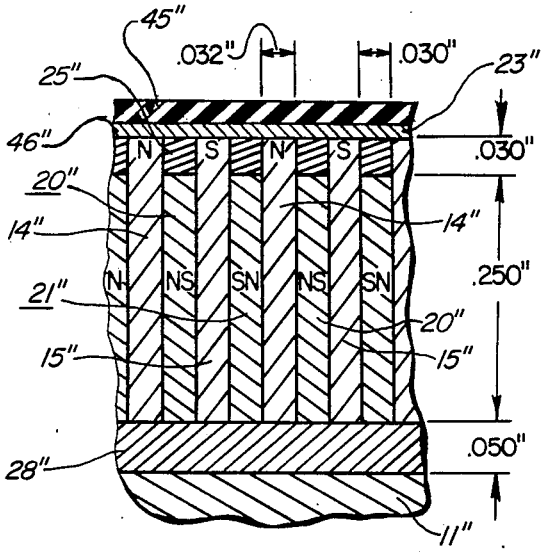
FIG. 13
FIG. 14
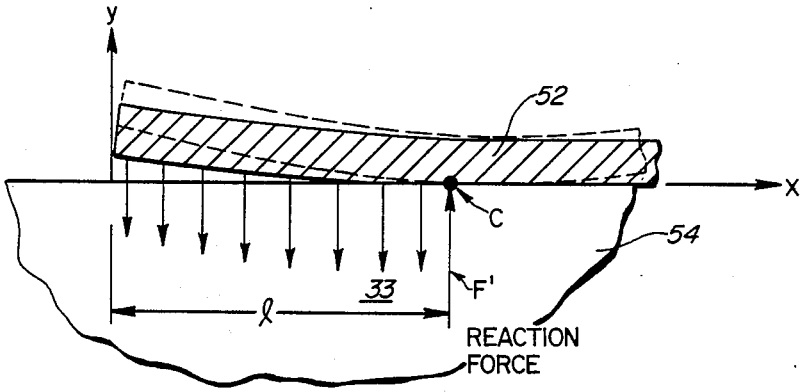
FIG. 15
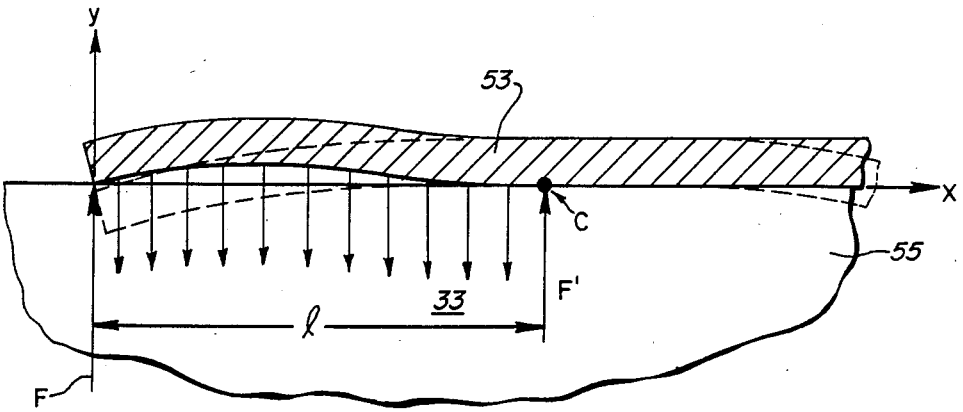

FIG. 18
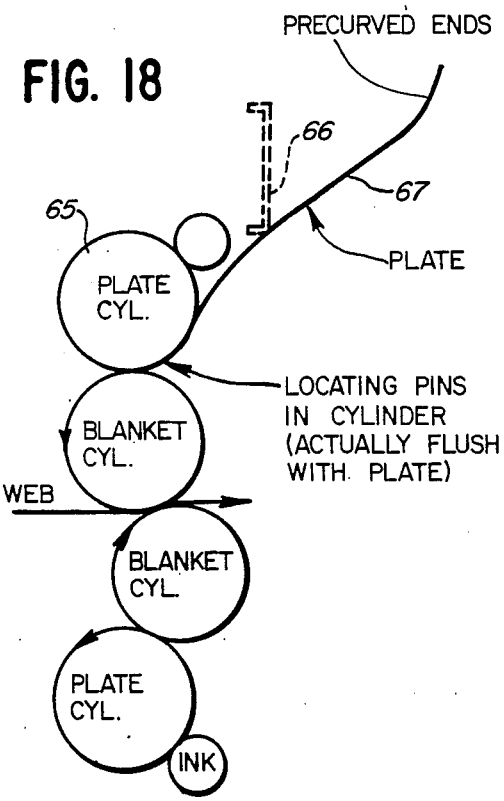
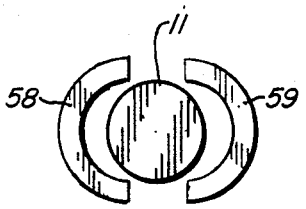
FIG. 16
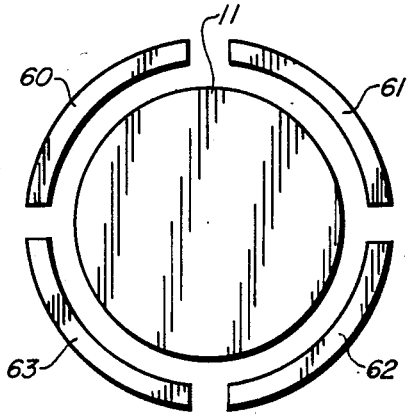
FIG. 17
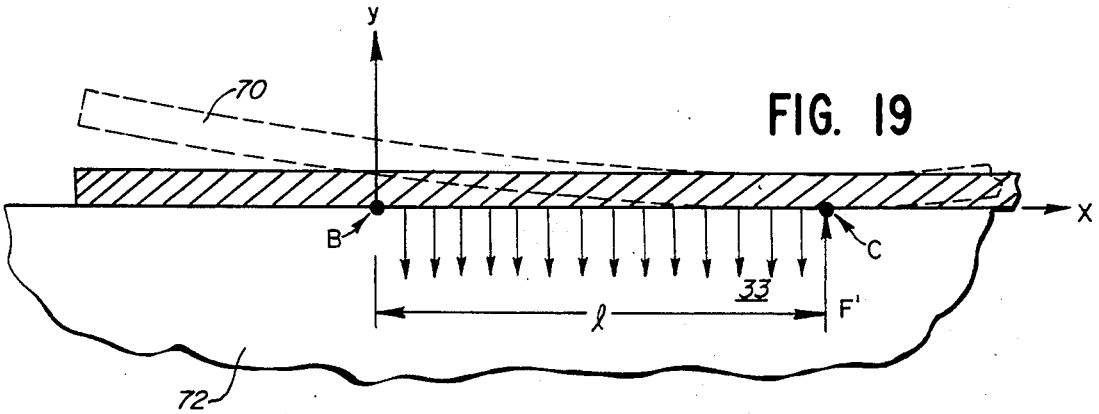
FIG. 19
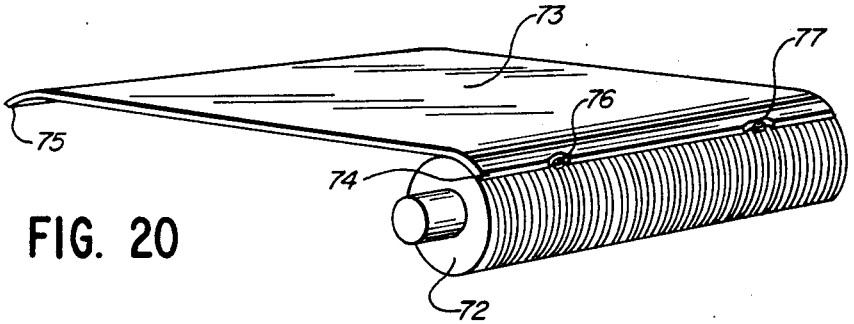
FIG. 20

MAGNETIC CYLINDERS WITH IMAGE PLATE OR BLANKET FOR OFFSET PRINTING

This application is a continuation-in-part of my application Ser. No. 610,044 filed May 14, 1984, now U.S. Pat. No. 4,625,928 and assigned to the assignee of this application.

This application relates to a magnetic cylinder with image and blanket plates as for use in rotary offset printing.

In rotary offset printing, ink is applied to a plate mounted on one cylinder. The ink is transferred to a resilient blanket on a second cylinder. A paper web is imprinted with the ink on the blanket. The plate and blanket cylinders have to accommodate a mechanism to hold the plate or blanket on the cylinder surface. This mechanism is typically located in a gap extending axially of the cylinder and having a circumferential dimension of the order of $\frac{3}{8}$ inch. That portion of the web which passes the blanket cylinder gap is not imprinted and represents scrap. This results in a significant expense. Moreover, the cylinders in a rotary web offset press rotate at a high speed and with substantial pressure between the cylinders. The gaps described above cause shock and vibrations which degrade printing quality and contribute to press wear. The gaps also destroy the symmetry of the cylinders, an undesirable condition in high speed rotation. Typically, bearer rings are provided at the ends of the cylinders to minimize the shock resulting from the gaps. These bearer rings and the cylinder shaft bearings carry heavy radial loads and are the source of regular maintenance problems.

Cylinders have been proposed to which a plate is held magnetically. Magnetic cylinders commercially available do not have sufficient holding capability for reliable operation in rotary web offset printing.

SUMMARY OF THE INVENTION

In accordance with the invention, a magnetic cylinder is provided comprising a cylindrical core with peripheral axially spaced permanent magnets. Adjacent magnets have opposite polarity. Pole pieces of magnetic material are provided between adjacent magnets. A plate of magnetic material extends circumferentially around the cylinder. The permanent magnets, pole pieces and plate form magnetic circuits in which the flux established by the permanent magnets substantially saturates the peripheral faces of the pole pieces and the annular sections of the plate between adjacent pole pieces. The plate may serve as the image plate which transfers ink in the desired pattern to the blanket, or as a carrier plate for the blanket.

A principal feature of the invention is that in the cylinder and image plate the magnetic circuits are characterized by a magnet width axially of the cylinder and a corresponding pole piece spacing axially of the cylinder to maximize the term $$\frac{w_0}{k^{\frac{1}{4}}} \quad (1)$$

where $w_0$ is the magnetic attractive force exerted on a unit area of the plate with no displacement between the plate and the cylinder surface; and k is the magnitude of the slope of the linear portion of a plot of w, the magnetic attractive force exerted on the plate area, as displacement of the plate area from the cylinder increases.

Another feature of the invention is that the magnetic circuits for the cylinder and blanket carrier plate are characterized by a magnet width axially of the cylinder and a corresponding pole piece spacing axially of the cylinder to maximize the attractive force exerted on the carrier plate with nominal displacement between the carrier plate and the cylinder surface.

Another feature of the invention is that the image plate and the blanket carrier plate are precurved, preferably with a radius less than that of the associated cylinder.

The image plate mounting procedure is such that only the end portions of the plate are precurved. Preferably, a transition curve is provided between the curved ends and the uncurved center of the image plate.

The blanket and blanket carrier plate are preferably provided in segments, each precurved throughout its entire length.

Further features and advantages will readily be apparent from the drawings and the following specification.

BRIEF DESCRIPTION OF THE DRAWINGS

FIG. 1 is a perspective view of a cylinder and image plate incorporating the invention, with a section cut away;

FIG. 2 is an enlarged fragmentary view showing a portion of the cylinder surface with the pole pieces in elevation and the magnets in section;

FIG. 3 is an enlarged fragmentary section of the magnetic structure and plate of a prior art cylinder showing relative dimensions of the magnets and pole pieces;

FIG. 4 is a diagram illustrating the magnetic force at the edge of a plate as the plate is lifted from the cylinder;

FIG. 13 is a section similar to FIG. 3 showing dimensions of the magnets and pole pieces in accordance with another embodiment of the invention;

FIG. 14 is a diagram illustrating the edge condition for an undercurved plate;

FIG. 15 is a diagram illustrating the edge condition for an overcurved plate;

FIG. 16 is a diagram illustrating a blanket cylinder with a blanket and carrier plate in two 180° segments;

FIG. 17 is a diagram illustrating a blanket cylinder with a blanket and carrier plate in four 90° segments;

FIG. 18 is a diagram illustrating the physical constraints in mounting an image plate on the cylinder of an offset press;

FIG. 19 is a diagram illustrating a transition curve between the curved plate ends and the uncurved center portion of the plate;

FIG. 20 is a perspective showing the image plate as it is mounted on the cylinder;

The printing roll 10, FIG. 1, has a cylindrical body 11 with stub shafts 12 extending from each end. The cylindrical body is preferably of the general construction shown in Wright U.S. Pat. No. 3,810,055. On the surface of the cylindrical body, two helical pole pieces 14, 15, FIG. 2, are spaced apart defining helical slots 17, 18. Magnets 20, 21 are located in the slots establishing a magnetic field through the pole pieces. The magnets have a radial dimension less than the pole pieces. Annular spacers 25, 26 overlie the magnets, filling the outer portion of the slots 17, 18. The field established by magnets 20, 21 holds a plate 23 on the surface of the cylinder. The plate 23 is not shown in FIG. 2.

Figure 5:
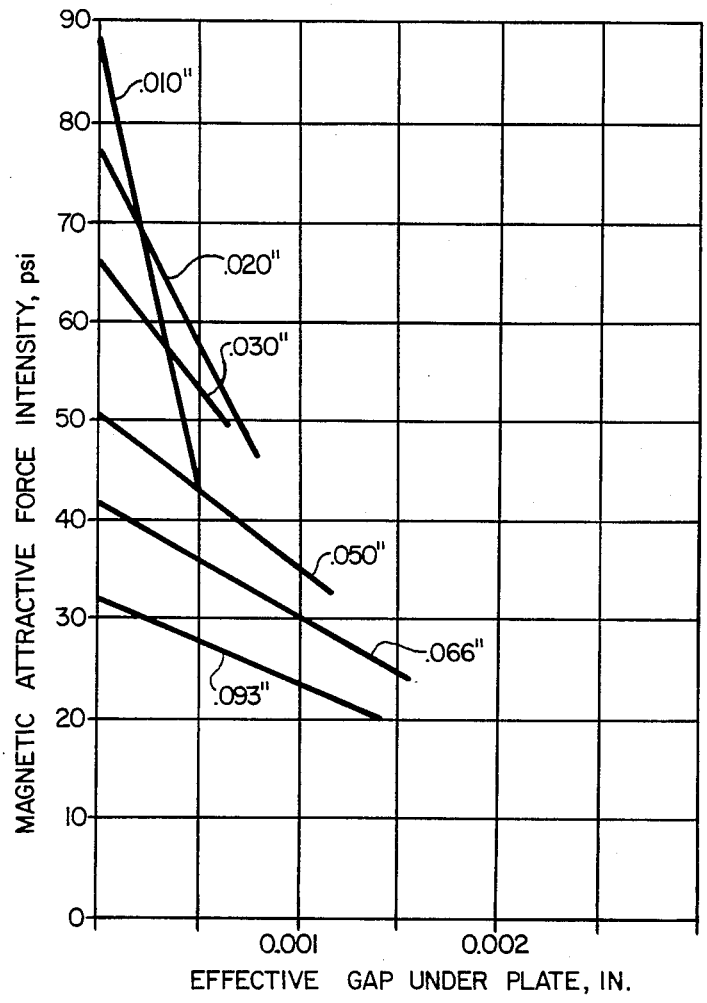
FIG. 5 is a series of plots of the magnetic attractive force intensity as a function of the gap between the plate and the cylinder for magnetic circuits with different magnet widths.

A typical printing cylinder is of the order of 40 inches in length and has a diameter of the order of 7.5 inches. The magnetic structure on the cylinder surface, i.e., magnets 20, 21, pole pieces 14, 15 and annular members 25, 26, has a radial dimension of less than ½ inch.

The cylinder body 11, which may be of steel, has a sleeve 28 of a nonmagnetic material thereon to isolate the magnetic structure from the body, see FIG. 3. Typically, the sleeve is of brass and has a radial dimension of 0.050 inch.

In the prior art magnetic cylinder, the magnets 20, 21 are a flexible rubber-like material impregnated with magnetic particles, sold by Minnesota Mining & Manufacturing Company under the trademark PLASTIFORM type B1013. The fields of the magnets are oriented with like poles of adjacent magnets facing each other, as indicated in the drawing. The magnets have an axial dimension of 0.093 inch and a radial dimension of 0.250 inch. Pole pieces 14, 15 are of a low reluctance material, preferably a stainless steel. AISI No. 430 ferritic stainless steel was used. This material resists corrosion by the inks, solvents and cleaners used in printing so that the peripheral surfaces of the pole pieces maintain the desired axial dimension and cylindrical configuration. The axial dimension of the pole pieces, here 0.032 inch, is determined by the coercive force of the magnets 20, 21 and the permeability of the pole piece material so that a condition of substantial saturation is achieved in the peripheral faces of the pole pieces with the image plate 23 mounted on the cylinder.

The image plate 23 is of magnetic material and has a thickness related to its reluctance such that substantial saturation is achieved in the annular plate sections between adjacent pole pieces 14, 15. In the example illustrated in FIG. 3 the image plate has a thickness of 0.015 inch. This thickness permits easy cutting and handling of the image plate.

It is preferred that the magnetic field in image plate 23 not exceed saturation. The existence of a stray field outside the image plate would attract particles of magnetic material to the image plate surface. This would result in poor printing quality and could damage the image plate. Furthermore, such a stray magnetic field does not contribute to the force holding the image plate on the cylinder but rather detracts therefrom. A condition of saturation of the order of 90–95 percent is satisfactory. A design to achieve a higher level of saturation requires an excessive increase in the magnetic force for a minimal increase in flux. Moreover, at such a high level of saturation, a stray field begins to appear outside the image plate, diminishing the gain in the force holding the image plate on the cylinder. A flux level much below 95 percent saturation represents inefficient utilization of the material in the pole pieces and image plate.

The annular members 25, 26 overlying magnets 20, 21 between the outer portions of the pole pieces 14, 15 are of a high reluctance material and minimize the flux path in shunt with plate 23. The prior art cylinder used an austenitic stainless steel, AISI No. 304.

The magnetic cylinder and image plate of FIG. 3 is not satisfactory for the severe environment of web offset printing. The magnetic cylinder has insufficient holding strength to prevent lift-off of the image plate from the cylinder with the tacky ink typically used in web offset printing. In accordance with the invention, a redesign of the magnetic circuits of the cylinder provides a substantial increase in the holding strength. The redesigned cylinders with image and blanket carrier plates precurved as described below have operated successfully in web offset printing tests.

During the following discussion various relationships will be considered analytically. The following glossary of symbols will aid in an understanding of this discussion:

B, C: end points of transition curvature
C: constants, equation (7)
E: Young's modulus
F: reaction force—end of plate
F′: reaction force at l
I: moment of inertia—beam cross section about neutral axis
k: proportionality constant, $$k = \frac{w_0 - w}{y}$$

l: contactless length of plate
M: moment across beam cross section (+ for curvature for +y)
$M_c$: residual moment, plate in contact with cylinder
P: externally applied radial lifting force (+ outward)
$P_{MAX}$: maximum value of P as l increases, equation (16)
q: transverse load intensity on beam (same sign as y)
R: radius of curvature
$R_c$: radius of cylinder
$R_f$: radius of curvature, free plate
s: flexural stress in a homogeneous plate
t: plate thickness
V: shear force across beam cross sections (+ for moment that increases +x)
w: magnetic attractive force per unit area $w_o$: w for y=0
x: circumferential coordinate
y: plate outward displacement
Y: effective gap between plate and cylinder
$\beta$: see equation (5)
$\nu$: Poisson's ratio The magnetic circuit of the cylinder and plate may have a strong attraction with no displacement (or only a small displacement) of the plate from the cylinder which attraction decreases rapidly when the displacement increases. Alternatively, the circuit may be such that the zero displacement attractive force is lower, but the attractive force decreases at a lesser rate as the displacement increases. The magnetic circuit of the prior art cylinder of FIG. 3 has such a low attractive force at zero displacement that it is unsatisfactory at any reasonable plate displacement.

A plate wrapped around a magnetic cylinder is subject to magnetic attraction forces which are opposed by contact force between the cylinder and plate. If the plate is precurved to match the cylinder radius, the plate is free of moments and, in the absence of external forces acting on the plate, the magnetic attraction forces are canceled by equal and opposite contact forces. External outwardly directed forces acting on the plate subtract from contact forces and if the external outward force does not exceed the magnetic attraction force, contact between the plate and cylinder is maintained.

If the externally applied force exceeds the magnetic attraction force within a given area of the plate, that area comes out of contact with the cylinder. The magnetic force decreases and the flexural stiffness of the plate becomes a factor in the plate behavior.

Magnetic image and blanket carrier plates are subject both to shifting in position on the cylinder and to localized lift-off as at an edge of the plate. Lift-off may be caused, for example, by the ink film splitting force which occurs along a line at the trailing edge of a plate-blanket or plate-roller nip and at the line where the web separates from the blanket. The force is a function of the tack of the ink and is a greater problem with inks used in web offset printing than with inks used for other types of printing where magnetic cylinders have previously been used.

The following magnetic and mechanical analysis is for a cylinder of the general construction shown in the Wright patent and in FIG. 3, having annular of helical pole pieces and magnets. The axial pitch is small and the forces and plate deflections are assumed to be constant in the axial direction. In situations of interest, the circumferential extent of the plate area out of contact with the cylinder surface subtends an arc of 0.1 radian (6°) or less. Treatment of the plate and cylinder areas as flat rather than curved introduces a negligible error and substantially simplifies the analysis. In the initial portion of the analysis surface roughness is neglected. A printing cylinder surface typically has a finish of 32 microinches RMS. Plate surfaces are usually smoother. The plate displacements of interest substantially exceed the surface asperity deformations.

Turning now to FIG. 4, plate 30 is shown on a magnetic cylinder 31. The axial direction is into the sheet. The edge 32 of the plate is separated from the cylinder by an outwardly directed force P applied to the plate edge. An orthogonal coordinate system has its origin at the contact boundary. The x coordinate is circumferential and the y coordinate is radial outwardly. The magnetic attraction force decreases as the plate displacement increases. For small displacements the attractive force decrease is linear. Thus, $$w = w_0 - ky \tag{2}$$

w is the magnetic attractive force per unit area at a location with dissplacement y;
$w_0$ is the magnetic attractive force for y=0; and
k is a proportionality constant.

In FIG. 4 the decrease in attractive force is graphically represented by a difference in length of the downwardly directed arrows 33 along the portion of the plate 30 separated from the cylinder 31 and having a length l.

The mechanical plate forces balancing the magnetic force may be expressed by the differential equation $$\frac{Et^3}{12(1-\nu^2)}\frac{d^4y}{dx^4} = -w_0 + ky \tag{3}$$

or $$\frac{d^4y}{dx^4} - \frac{12(1-\nu^2)k}{Et^3}y = \frac{12(1-\nu^2)w_0}{Et^3} \tag{4}$$

where
E is Young's modulus for the plate material;
t is the plate thickness; and
$\nu$ is Poisson's ratio.

Defining $$\beta \equiv \left(\frac{12(1-\nu^2)k}{Et^3}\right)^{\frac{1}{4}} \tag{5}$$

and substituting $$\frac{d^4y}{dx^4} - \beta^4 y = -\beta^4\frac{w_0}{k} \tag{6}$$

The general solution for this differential equation can be expressed $$y = C_1\cosh\beta x + C_2\sinh\beta x + C_2\cos\beta x + C_4\sin\beta x + \frac{w_0}{k} \tag{7}$$

where the C's are arbitrary constants to be evaluated from the boundary conditions of the system.

Considering the system illustrated in FIG. 4, the conditions at x=0 (the contact boundary) are:

$$y_0 = 0. \tag{8}$$

There is no abrupt bend in the plate and the slope is continuous, therefore $$\left.\frac{dy}{dx}\right)_o = 0. \tag{9}$$

The plate has no mechanical hold-downs as screws or adhesive. Accordingly, there is continuity of moments in the plate and $M_0=0$. Therefore, $$\left.\frac{d^2y}{dx^2}\right)_o = 0. \tag{10}$$

A force, not a couple, is applied at the plate edge where x=l. Accordingly, $M_l=0$ and $$\left.\frac{d^2y}{dx^2}\right)_l = 0. \tag{11}$$

From these boundary conditions the constants are evaluated and $$y = \frac{w_o}{2k}\left\{\left[\frac{\cosh\beta l - \cos\beta l}{\sinh\beta l + \sin\beta l}\right](\sinh\beta x - \sin\beta x) - \cosh\beta x - \cos\beta x + 2\right\}. \tag{12}$$

At the plate edge the shear force V is equal to the externally applied outward force P. The direction of P produces a moment which increases in the direction of negative x. Accordingly, $$V)_l = \left.\frac{dM}{dX}\right)_l = \frac{Et^3}{12(1-\nu^2)}\left.\frac{d^3y}{dx^3}\right)_l = -P \tag{13}$$

Substituting y and $\beta$, $$P = \frac{1}{2}\left(\frac{E}{12(1-\nu^2)}\right)^{\frac{1}{4}} t^{\frac{3}{4}}\frac{w_o}{k^{\frac{1}{4}}}\left\{\sinh\beta l + \sin\beta l - \frac{\cosh^2\beta l - \cos^2\beta l}{\sinh\beta l + \sin\beta l}\right\} \tag{14}$$

As the contactless length l in FIG. 4 increases from 0, P increases until it reaches a maximum and then decreases. For the maximum vaue of P, $$\beta l = 1.875104. \tag{15}$$

The maximum value of P is $$P_{MAX} = \frac{1}{2}\left(\frac{E}{12(1-\nu^2)}\right)^{\frac{1}{4}} t^{\frac{3}{4}}\frac{w_o}{k^{\frac{1}{4}}}\{1.468\ 191\} \tag{16}$$

The design of the magnetic circuit of the cylinder affects both $w_0$, the attractive force intensity at zero displacement and k, the attractive force proportionality constant. The quantity $$\frac{w_0}{k^{\frac{1}{4}}}$$

will be referred to as the peel-off resistance parameter for the magnetic circuit.

In FIG. 5 there is a plot of magnetic attractive force intensity as function of effective plate gap for several different magnetic circuits. The circuits each utilize the 3M Plastiform magnetic material with pole pieces having a width of 0.032 inch and a plate having a thickness of 0.015 inch, as in the commercial cylinder of FIG. 3 manufactured by T. D. WRight in accordance with U.S. Pat. No. 3,810,055. The magnet widths range from 0.093 inch (the width used in Wright's commercial cylinder) down to 0.010 inch. Conversely, the pole piece spacing ranges from 8 poles per inch (with 0.093 inch magnets) to 24 poles per inch (with 0.010 inch magnets).

Figure 23:
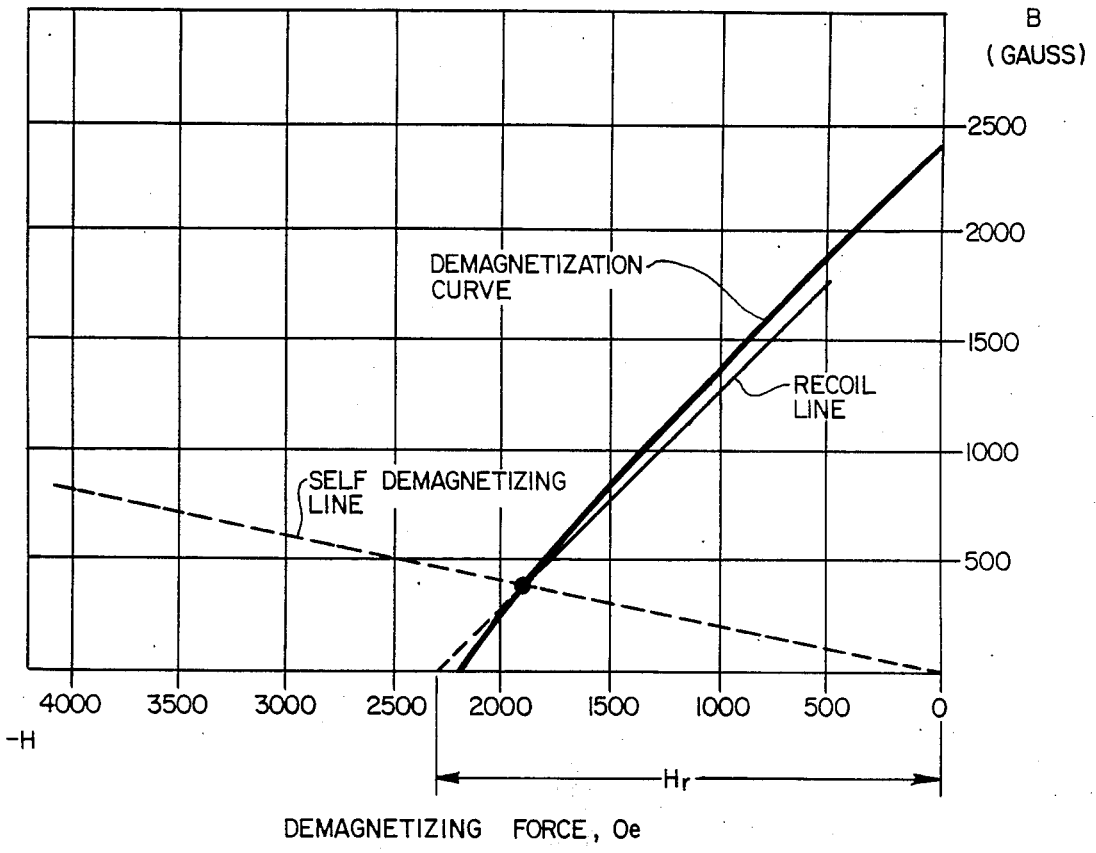
FIG. 23 is a demagnetization curve.

The principal characteristics of interest for the magnetic material are $\mu_r$, the slope of the recoil line, and $H_r$, the magnitude of the intercept of the recoil line on the H-axis of the demagnetization curve. See FIG. 23 where a typical demagnetization curve is illustrated. The term $\mu_r$ is sometimes referred to as the recoil permeability.

The magnetic attractive force intensity with zero effective gap is greatest for the small magnets with a large number of pole pieces. The small magnet systems also exhibit the largest proportionality constant and the attractive force drops off rapidly as the gap increases. Conversely, the systems with larger magnets have a lesser attractive force at zero gap but a smaller proportionality constant so that a substantial attractive force is maintained as the gap increases. Each of the plots of FIG. 5 is labeled with the magnet width.

Figure 6:
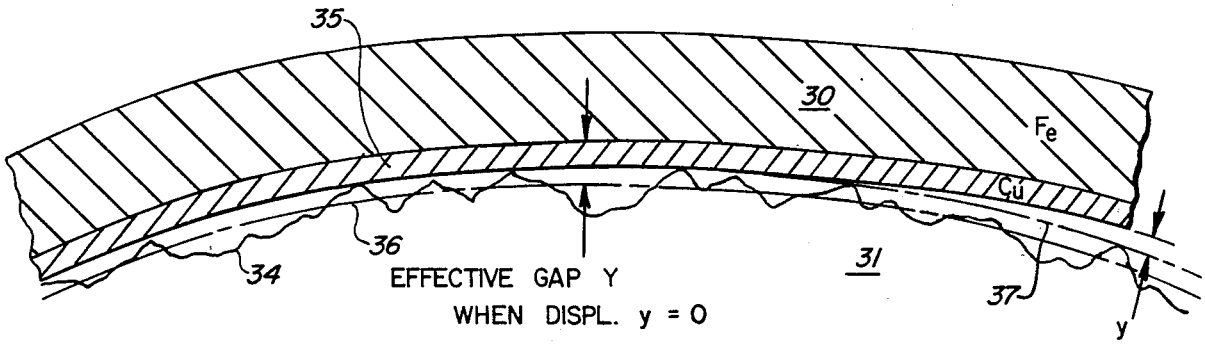
FIG. 6 is an enlarged diagram illustrating in exaggerated form displacement of the plate from the cylinder and the gap between the plate and cylinder.

In practical cylinders and plates, the gap between the plate and the pole pieces is not reduced to zero. As pointed out above, the cylinder surface typically has a finish with 32 microinch RMS roughness. The offset image plate has a 200 microinch copper layer on the under surface. Lint particles cannot practically be eliminated and typically may have a 200 microinch diameter. FIG. 6 illustrates in greatly enlarged scale the cylinder 31 having a surface with asperities 34, and plate 30 with a copper layer 35. Broken line 36 indicates the mean cylinder surface and line 37 connects the tops of the surface asperities. The image plate displacement y represents the distance between the inner surface of copper layer 35 and the curve 37 connecting the tops of the surface asperities. The effective gap Y is the distance between the inner surface of steel plate 30 and the mean cylinder surface 36. With displacement y=0, the minimum effective gap $Y_{MIN}$ is the sum of the cylinder surface roughness, foreign matter and copper layer thickness. A conservative figure for $Y_{MIN}$ used in subsequent analysis is 450 microinches.

Figure 7:
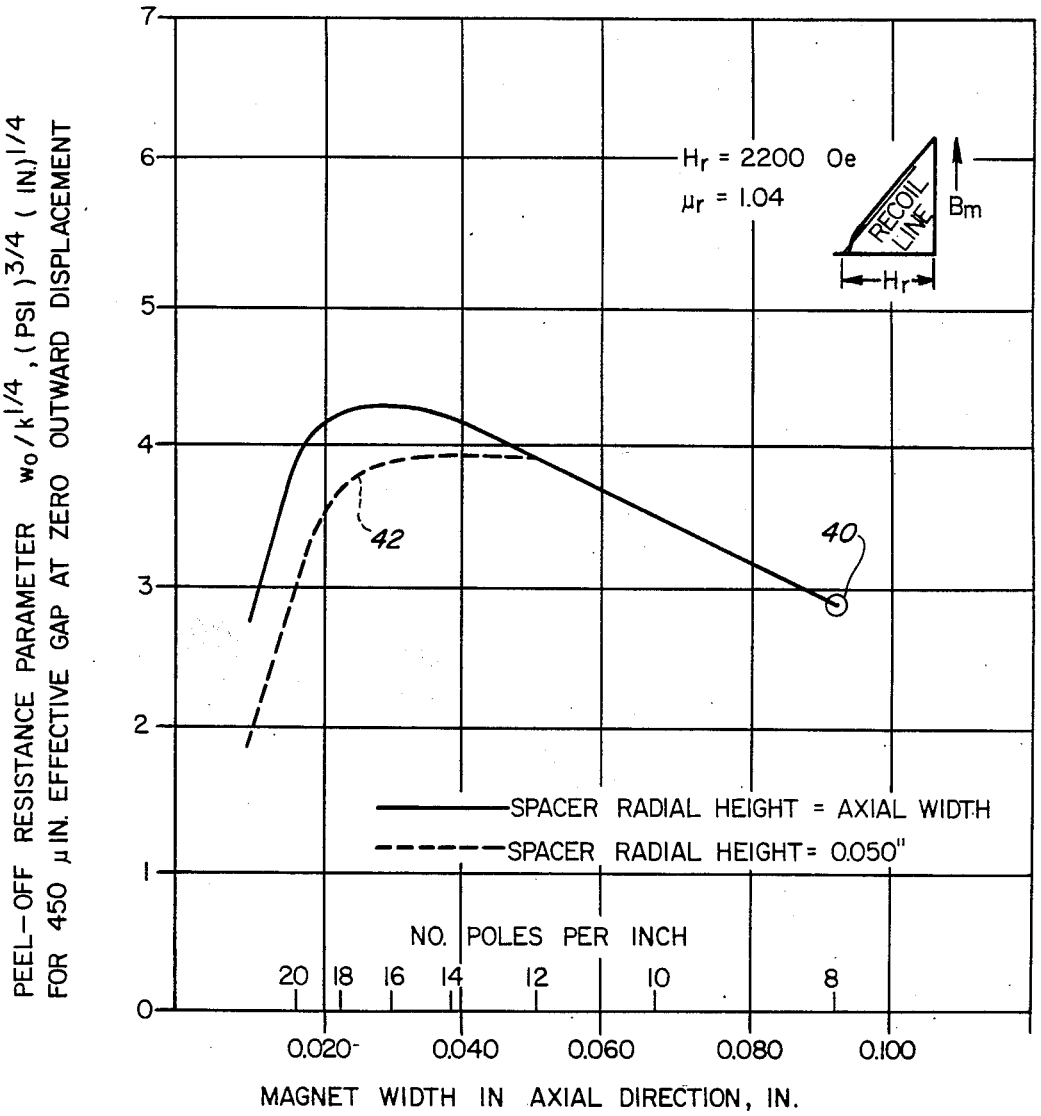
FIG. 7 is a plot of the peel-off resistance parameter as a function of magnet width.

Turning now to FIG. 7, there is a plot of the peel-off resistance parameter $$\frac{w_0}{k^{\frac{1}{4}}}$$

for cylinders with magnets of the Plastiform material of various widths and with a 450 microinch effective gap at zero plate displacement. The $H_r$ value (FIG. 23) of the Plastiform material is close to its coercive force of 2,200 Oersteds and the recoil permeability or slope of the recoil line is 1.04. The abscissa of the curve of FIG. 7 indicates both magnet width and the number of poles per inch. These dimensions could be expressed in units other than English. In any case, it is convenient to consider the number of poles for a unit of axial length of the cylinder as an integer.

The prior art commercial cylinder of T. D. Wright, FIG. 3, had 8 poles per inch with a peel-off resistance parameter indicated at point 40 on the curve of FIG. 7. A significant improvement in the peel-off parameter is realized by reducing the magnet width and increasing the number of poles per inch. Increasing the poles from 8 per inch to 12 per inch decreases the peel-off resistance parameter almost 35 percent. A further increase to 14 poles per inch increases the peel-off parameter only about 7½ percent. A 12 pole per inch plate cylinder performed well in field tests with severely tacky ink.

Other factors are important in selecting the preferred magnetic circuit for the image plate cylinder. For reasons of mechanical strength the ratio of height to width of the mechanical spacers 25, 26 is preferably at least one. The solid line curve of FIG. 7 represents the peel-off resistance for a cylinder construction with the magnet spacers 25, 26 having a radial height equal to their axial width. However, an image plate cylinder preferably has plate register or locating pins (described below) which are seated in holes drilled in the cylinder. The drilling operation in an assembly with spacers having a radial height less than 0.050 inch causes local destruction of the components. Dashed line curve 42 represents the peel-off resistance of the cylinder with magnet spacers having a radial height of 0.050 inch with narrower magnets. There is no increase in peel-off resistance over the 12 pole per inch construction with 14 or 16 poles per inch. Accordingly, the 12 pole per inch construction is optimum for the image plate cylinder described, under typical operating conditions.

Figure 8:
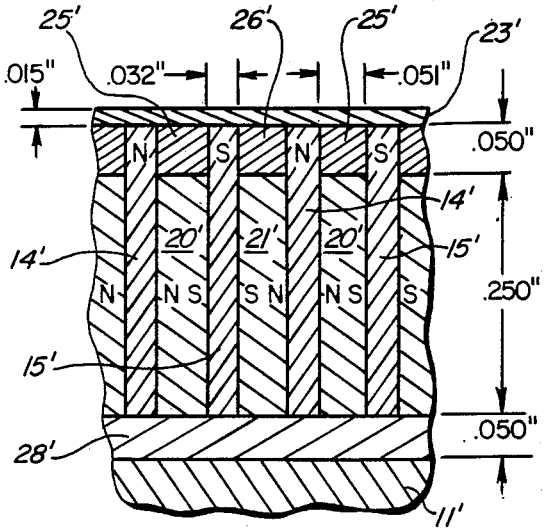
FIG. 8 is a section similar to FIG. 3 showing dimensions of the magnets and pole pieces in accordance with one embodiment of the invention.

The preferred 12 pole per inch construction for the plate cylinder construction with the Plastiform magnets is illustrated in FIG. 8 which shows the relative dimensions and spaces of the magnets and spacers. The elements are indicated by the same reference numerals as in FIG. 3 with prime indications. The spacers 25' and 26' are preferably of AISI No. 310 stainless steel, which maintains high reluctance under all conditions.

The prior art cylinder of FIG. 3 may be compared with the preferred image plate cylinder of FIG. 8 with respect to the ratio of pole piece to magnet area on the outer surface of the cylinder. With the prior art cylinder the ratio is 0.34 to 1. With the cylinder of FIG. 8, the ratio is 0.63 to 1.

Figure 9:
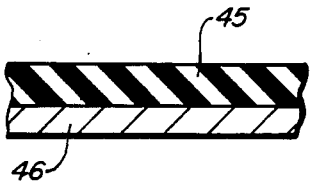
FIG. 9 is a fragmentary section illustrating an offset printing blanket bonded to a carrier plate.

The offset printing blanket is a resilient sheet, generally a composite material of elastomer and fabric reinforcing. In order to mount the blanket on a magnet cylinder, a magnetic material must be incorporated in the blanket. As pointed out above, the stiff mechanical flexural characteristics of the sheet mounted on the cylinder contribute to the peel-off resistance. A steel carrier plate is preferable, rather than steel particles embedded in the blanket, for example. Such a structure is shown diagrammatically in FIG. 9 where blanket 45 is bonded to stainless steel carrier plate 46. For a cylinder with 0.032 pole piece width, the plate will have a thickness of the order of 0.015 inch, as in the image plate. Plates with a thickness of 0.018 inch are more readily available commercially and have been found satisfactory.

Figure 10:
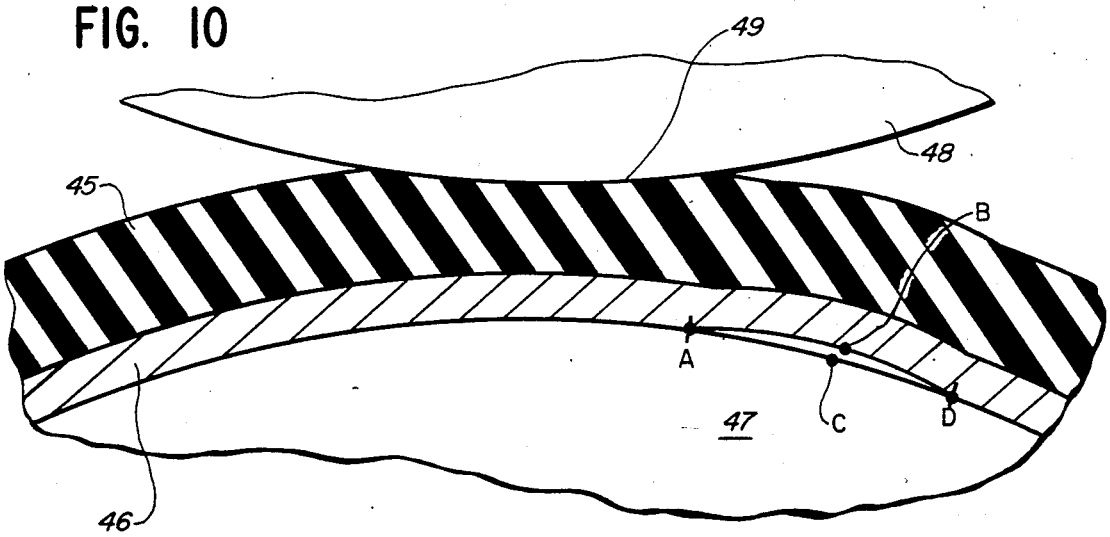
FIG. 10 is a diagram illustrating the blanket and carrier plate in a nip showing the action which, it is believed, causes circumferential displacement of the blanket on the cylinder.

A blanket bonded to a steel substrate has been observed to undergo gradual circumferential movement around a magnetic cylinder during web printing. It is suspected that this movement occurs as a result of local separation of the blanket mounting plate from the cylinder adjacent to a nip, as the plate-blanket nip. This local separation is illustrated as a wave-like action in FIG. 10 where the blanket 45 and blanket mounting plate 46 are carried on a magnetic cylinder 47 which rotates in a counterclockwise direction. The cylinder 48 with which a nip is formed at 49 rotates in a clockwise direction. In a small area where blanket 45 enters the nip, the nip forces cause the blanket carrier plate 46 to lift from the surface of cylinder 47. The plate length ABD is slightly longer than cylinder surface ACD. Accordingly, blanket 45 and carrier plate 46 move in a direction opposite the direction of rotation a slight distance on each cylinder revolution. A moment due to tangential nip force may be one cause of the carrier plate liftoff adjacent the nip. Also, with some blanket structures a high nip pressure in the radial direction can cause tensile stresses in the radial direction near the entry and exit from the nip. If these tensile stress components exceed the magnetic attractive force intensity, liftoff will occur. A mismatch in carrier plate precurvature (to be discussed below) adjacent the leading edge of the blanket may also result in a contactless region which will be driven circumferentially by the nip.

If liftoff of the blanket carrier plate is eliminated, circumferential blanket movement is suppressed. Accordingly, both the peel-off resistance and the magnetic attractive force at zero or small plate displacements are important considerations. With respect to the peel-off resistance, the effective gap for zero displacement includes the cylinder surface roughness of 50 microinches and an allowance for lint of 200 microinches. The peel-off resistance parameter is plotted as a function of magnet width for 250 microinch effective gap at zero plate displacement in FIG. 11. In considering the magnetic attractive force to suppress circumferential movement, an estimated wave height (FIG. 10) of 100 microinches and an estimated gap from leading edge overcurvature (described below) of 50 microinches are added to the effective gap for zero plate displacement. Factors such as these are referred to herein as a "nominal displacement" between the carrier plate and cylinder surface. In FIG. 12 the magnetic attractive force intensity is plotted as a function of magnet width for a 400 microinch gap.

Figure 11:
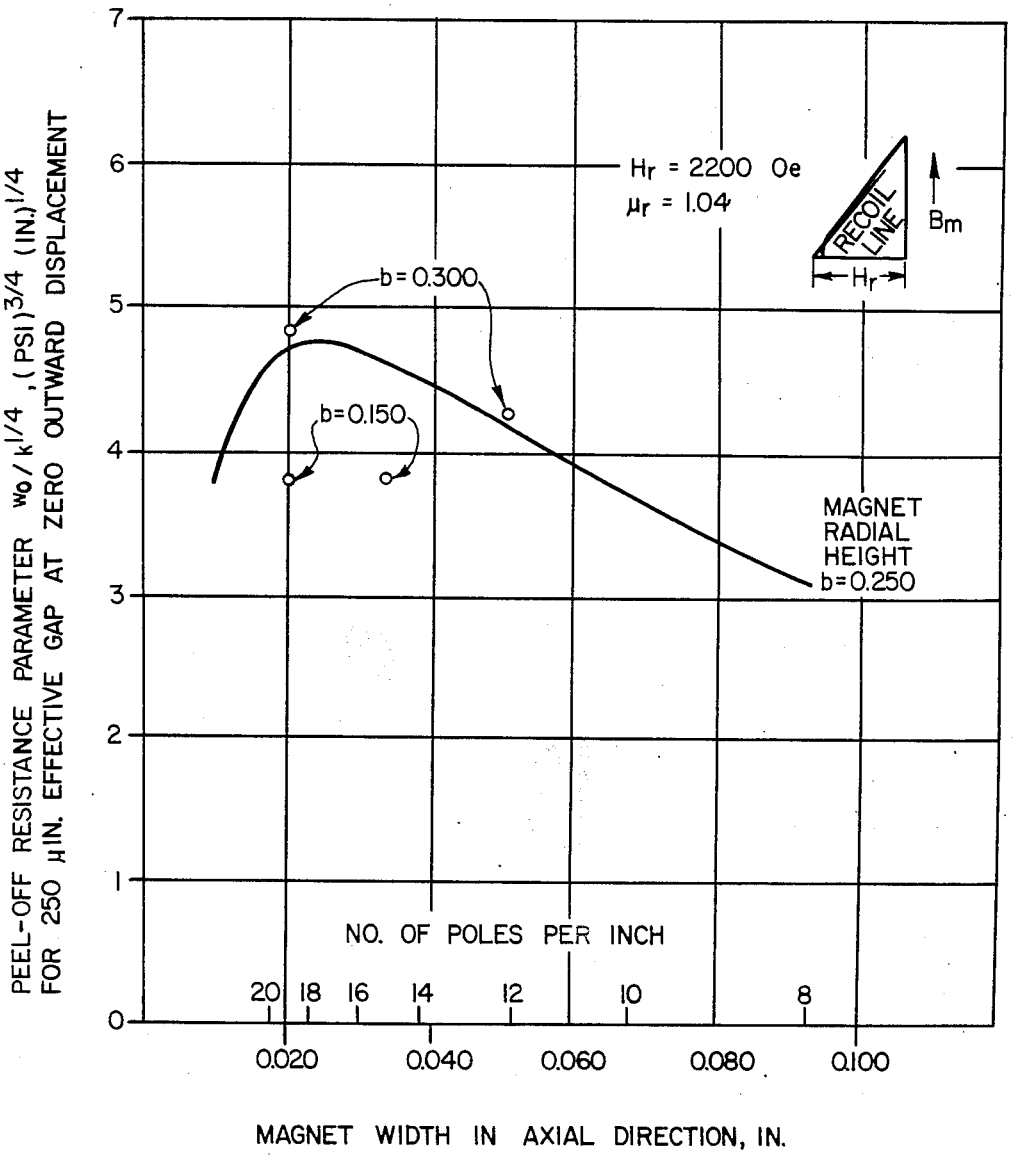
FIG. 11 is a plot of the peel-off resistance parameter as a function of magnet width for a blanket and carrier plate.
Figure 12:
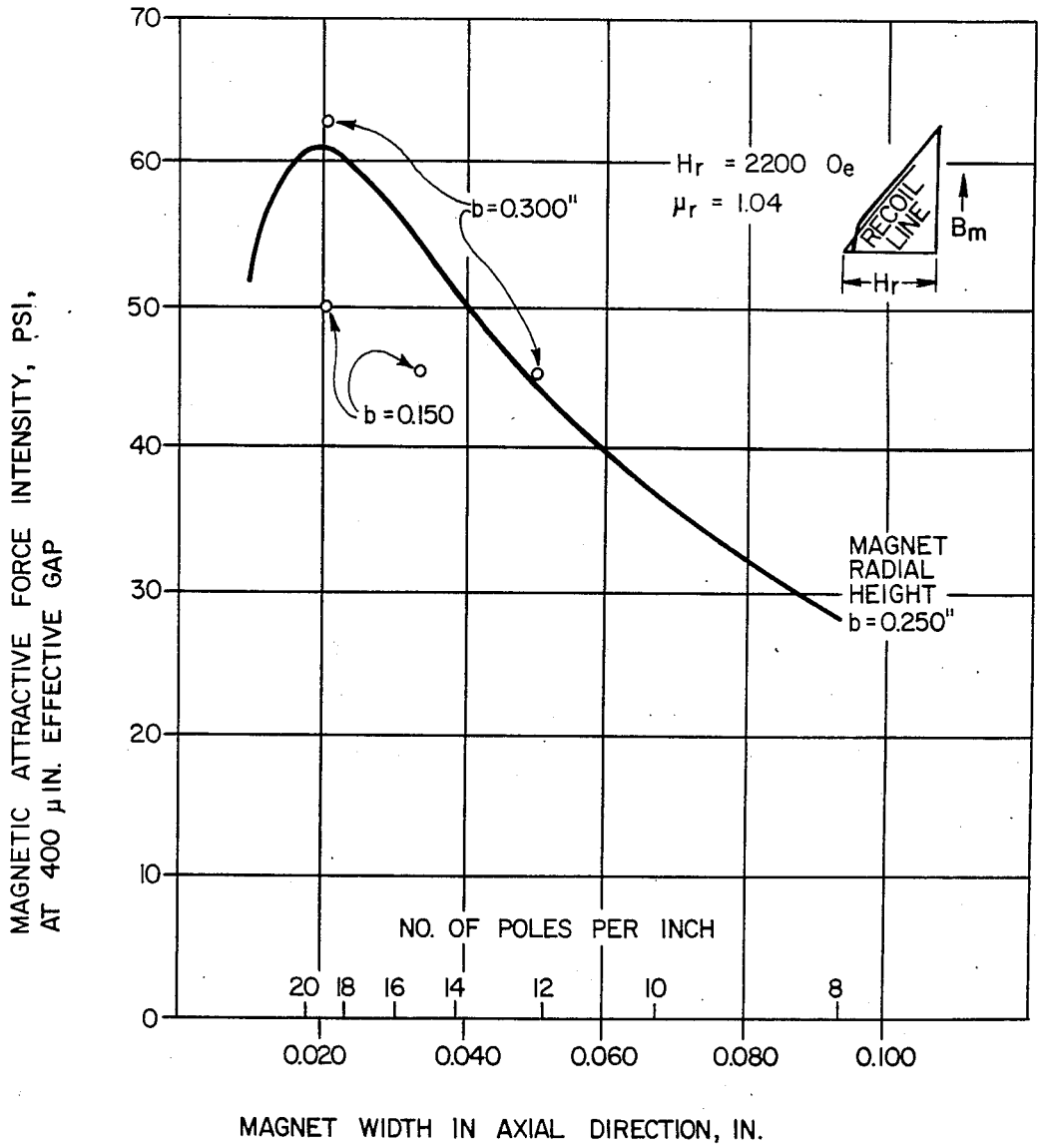
FIG. 12 is a plot of magnetic attractive force intensity as a function of magnet width for a blanket and carrier plate.

From an examination of FIGS. 11 and 12, both the 16 pole per inch and the 18 pole per inch cylinder designs are satisfactory for the blanket cylinder in typical web offset printing conditions. The 16 pole design is preferable as the smaller magnets are more difficult to handle in manufacturing. FIG. 13 shows the dimensions for the 16 pole construction. The elements are identified by the same reference numerals as in FIGS. 3 and 8, with a double prime.

Accordingly, for the Plastiform magnetic material and the web offset printing conditions described, the optimum plate cylinder has magnetic circuits with 12 poles per inch and an area ratio of the pole pieces to the magnets of the order of 0.6, FIG. 8. The optimum blanket cylinder magnetic circuits have 16 or 18 poles per inch and an area ratio of pole pieces to magnets of the order of 1.0 to 1.4.

The prior art T. D. Wright commercial cylinders have 8 poles per inch with an area ratio of pole pieces to magnets of 0.34. The preferred plate cylinder construction has a peel-off parameter about 35 percent greater than that of the Wright commercial cylinder. The blanket cylinder with 16 poles per inch has a peel-off resistance parameter 50 percent greater than that of the Wright cylinder and a magnetic attractive force intensity almost two times that of Wright at 400 microinch effective gap and estimated liftoff displacement.

The foregoing analysis is based largely on assumption of a flat cylinder and plate. It is desirable to precurve the printing plate and the blanket carrier plate to reduce or minimize mechanical forces tending to lift a plate area from the cylinder surface. The residual moment across a plate cross section is a function of the radius of curvature of the free plate, $R_f$, and the radius of the cylinder, $R_c$, $$M_c = \frac{Et^3}{12(1-\nu^2)}\left(\frac{1}{|R_f|} - \frac{1}{|R_c|}\right) \tag{17}$$

The moment is negative if the plate 52 is undercurved, FIG. 14, and positive if the plate 53 is overcurved, FIG. 15.

In situations of practical interest, the displacement of the plate from the cylinder arising from a curvature mismatch are much smaller than the displacement which may be tolerated in the case of edge peel-off. In considering precurvature tolerance, it is therefore reasonable to neglect the variation of the magnetic attractive force intensity with plate displacement and to approximate w as a constant.

In FIG. 14, continuity of moment in the plate 52 requires that at the contact boundary C, the plate length l out of contact with the cylinder 54 is $$l = \left(\frac{2(-M_c)}{w}\right)^{\frac{1}{2}} \tag{18}$$

The outward displacement $y_E$ of the plate edge is $$y_E = \frac{Et^3}{24(1-\nu^2)}\ \frac{1}{w}\left(\frac{1}{|R_f|} - \frac{1}{|R_c|}\right)^2 \tag{19}$$

In the case of the overcurved plate 53 illustrated in FIG. 15, the dotted curve represents the difference between the plate and cylinder curvature if the cylinder 55 and magnetic effects are removed while the plate is fixed at point C. The maximum plate deflection, $y_{MAX}$, is $$y_{MAX} = \frac{3}{512}\ \frac{Et^3}{(1-\nu^2)}\ \frac{1}{w}\left(\frac{1}{|R_f|} - \frac{1}{|R_c|}\right)^2 \tag{20}$$

and the plate length l out of contact with the cylinder is $$l = 2\left(\frac{Et^3}{12(1-\nu^2)}\right)^{\frac{1}{2}} \frac{1}{w^{\frac{1}{2}}}\left(\frac{1}{|R_f|} - \frac{1}{|R_c|}\right)^{\frac{1}{2}} \tag{21}$$

The edge reaction force F, per unit width, is $$F = \frac{3}{2}\left(\frac{Et^3}{12(1-\nu^2)}\right)^{\frac{1}{2}} \frac{1}{w^{\frac{1}{2}}}\left(\frac{1}{|R_f|} - \frac{1}{|R_c|}\right)^{\frac{1}{2}} \tag{22}$$

The plate edge remains in contact with the cylinder 55 unless an externally applied outward force exceeds the reaction force.

Comparing the expressions for $y_E$ and $y_{MAX}$, for the same magnitude of difference in the radii of the plate and the cylinder, it is seen that the maximum outward displacement of the plate is much less for an overcurved plate than for an undercurved plate. Accordingly, plate curvature tolerance should favor overcurvature rather than undercurvature.

Tests of an image cylinder with 12 poles per inch and a plate with leading and trailing edges curved on a radius of the order of 3.0 inches (approximately 0.75 inch less than the cylinder radius) indicate no adverse results from the overcurvature. This overcurvature represents a $y_{MAX}$ value of the order of 80 microinches. An added safety factor is provided if the overcurvature is reduced such that $y_{MAX}$ is no greater than 50 microinches.

It is desirable to limit $y_{MAX}$ for the blanket and carrier plate to a smaller value in order to suppress circumferential movement. This requires a closer tolerance for the precurve of the blanket carrier than for the image plate. However, many presses are designed with a double size blanket cylinder diameter of 15 inches rather than 7.5 inches, to minimize blanket cylinder vibration. With a double size blanket cylinder, the carrier plate radius tolerance for a given $y_{MAX}$ is relaxed by roughly a factor of 4. A radius differential of 1.5 inch, for example, has a $y_{MAX}$ value of about 15 microinches. Limiting $y_{MAX}$ to 10 microinches is practically obtainable.

With some offset presses the location of the plate cylinder is such that it is undesirable to precurve the image plate for a full 360°. Accordingly, only the end portions are precurved as described below. The blanket carrier plate is preferably curved through 360°. Moreover, where the press is to print 2-around, the blanket and carrier plate may be precurved in two 180° segments 58, 59, FIG. 16. With a double size blanket cylinder printing 4-around, the blanket and carrier plate may be in four 90° segments, 60, 61, 62, 63, FIG. 17.

The physical configuration of most presses, e.g., a Goss C-38 press, is such that it is undesirable to precurve the full 360° of the image plate. Only the leading and trailing edges are precurved to insure adequate magnetic holding strength. As illustrated in FIG. 18, the relative locations of plate cylinder 65 and ink train guard 66 are such that the center portion of the plate 67 undergoes an elastic backward bend in the process of mounting the plate on the cylinder. If the middle portion of the plate were precurved, the backward bend might cause plastic deformation of the plate and result in a kink.

Where there is an abrupt transition in plate precurvature, as between a precurved edge and an uncurved middle section, there is a region at the transition which does not contact the cylinder. The contactless region is eliminated by a precurved transition area between the precurved edge and the uncurved middle. In FIG. 19 the dashed line curved plate 70 represents the displacement due to the difference in curvature between the plate and cylinder, in the absence of a magnetic attractive force, while contact is maintained at point C. In the region to the left of point B the plate precurvature is assumed to match the cylinder curvature. To the right of point C, the plate is uncurved or has a constant undercurvature. The transition region is between points B and C. The radius of curvature in the transition region is a function of x where x is less than l, $$|R_f|_x = \frac{1}{\frac{1}{|R_c|} - \left(\frac{1}{|R_c|} - \frac{1}{|R_f|}\right)\frac{x^2}{l^2}} \tag{23}$$

When the middle portion of the plate is uncurved, -

$$|R_f|_x = \frac{|R_c|}{1\frac{x^2}{l^2}} \tag{24}$$

The length l of the transition region when the middle portion of the plate is uncurved is $$l = \left(\frac{Et^3}{12(1-\nu^2)}\right)^{\frac{1}{2}}\left(\frac{2}{w_o|R_c|}\right)^{\frac{1}{2}} \tag{25}$$

The foregoing relationships establish a transition region with shape and extent adequate for barely suppressing lift-off in the transition region. If it is desired to maintain a constant contact pressure in the transition region, the length of the transition region is increased.

The extent of matching curvature or overcurvature at the plate leading and trailing edges should exceed the contactless length from the edge when $P_{MAX}$ is reached in peel-off, by adequate safety factor, as at least a multiple of three. If a transition region is not used, the extent of matching curvature should be increased further to include several times the minimum length of the transition region. Tests have indicated that a contactless region at an abrupt transition has little or no practical consequence provided that it is sufficiently far removed from the leading and trailing edges of the plate.

The cylinder 72 and image plate 73 with precurved leading and trailing edges 74, 75 are shown in perspective in FIG. 20. Register pins 76, 77 extend radially outwardly from the cylinder surface. A semicircular notch and an elongated notch in the leading edge surface receive pins 76, 77, respectively, and locate the image plate 73 circumferentially and axially on the cylinder 72. After positioning the leading edge 74 of the plate against the pins 76, 77, as shown, the cylinder is rotated and the remainder of the image plate is wrapped around the cylinder surface.

The foregoing discussion is concerned primarily with the Plastiform B1013 magnet material. Other magnet materials with higher coercive forces are available.

Plastic bonded or elastomer encapsulated rare earth powder magnet materials from Active Magnetics, Inc. have a coercive force of the order of 5,600 Oersteds and a recoil permeability of 1.1. Neodymium-iron magnets have a coercive force of the order of 9,800 Oersteds and a recoil permeability of 1.1. Several companies, including General Motors, Colt Industries (Crucible Div.), Electronic Memories and Magnetics (Indiana General Div.) and Sumitomo Special Metals have developed such magnet material.

Figure 21:
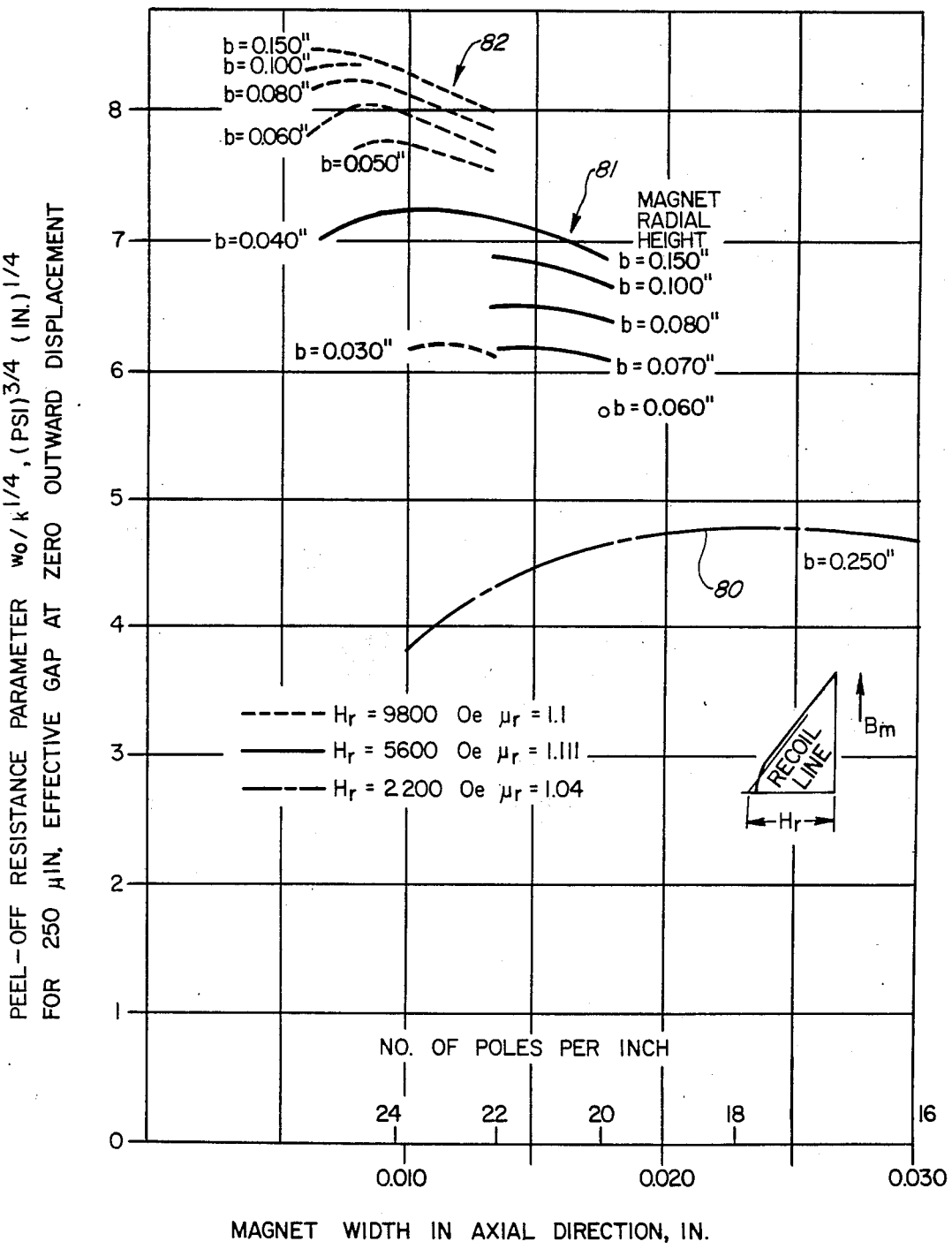
FIG. 21 is a plot of peel-off resistance as a function of magnet width for cylinders with three magnets of different characteristics.
Figure 22:
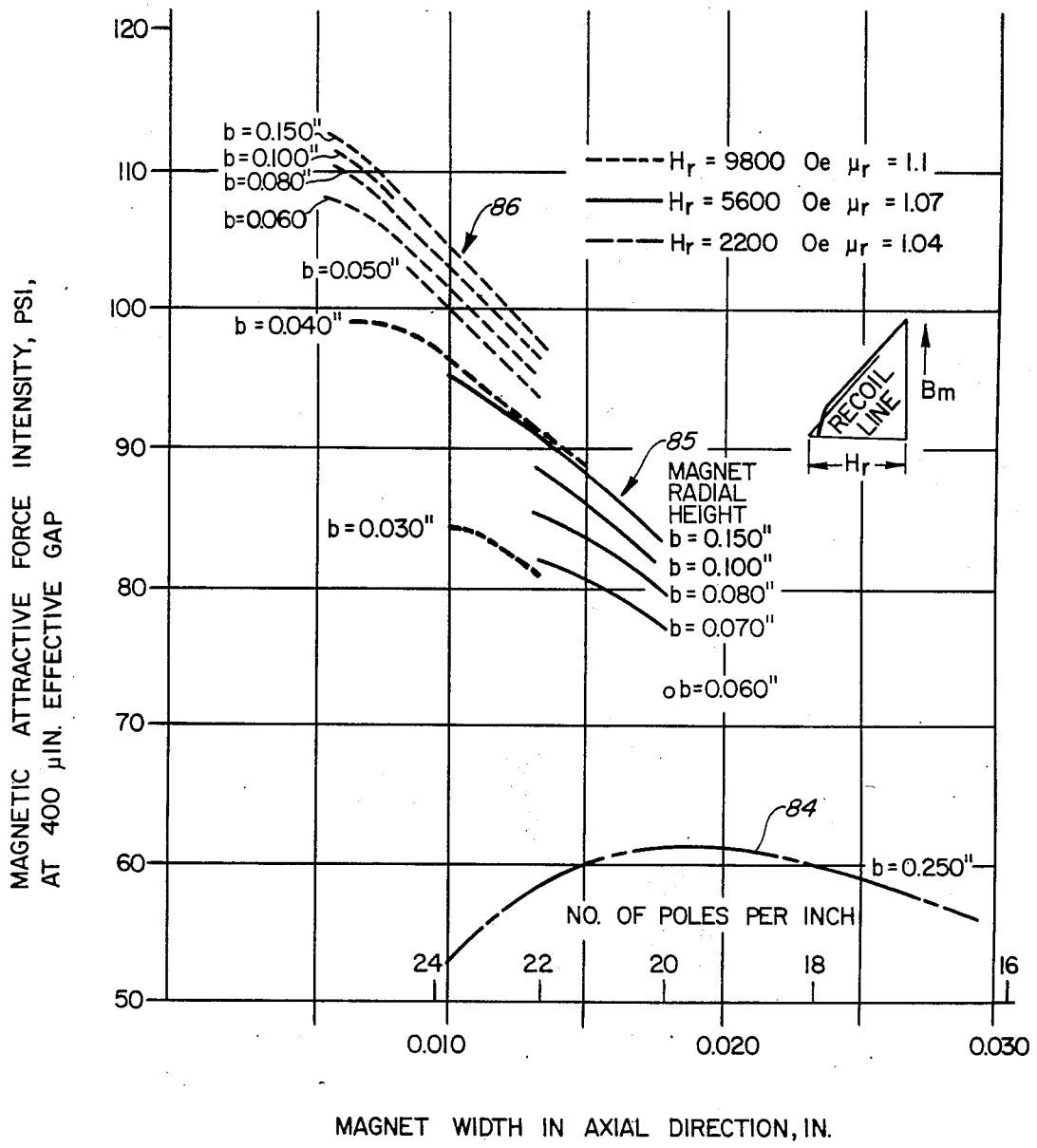
FIG. 22 is a plot of magnetic attractive force intensity as a function of magnet width for cylinders with three magnets of different characteristics.

FIG. 21 illustrates the peel-off resistance parameter, as a function of magnet width, assuming a 250 microinch effective gap at zero plate displacement for each of these materials. The broken line curve 80 is for the Plastiform B1013 material. The solid line curves 81 represent the rare earth material and the dashed line curves 82 the neodymium-iron material for several different magnet radial dimensions, b. FIG. 22 is a plot of curves representing the magnetic attractive force intensity, as a function of magnet width assuming a 400 microinch effective gap and estimated liftoff displacement. Broken line curve 84 is for the Plastiform material. Curves 85 represent rare earth magnets and curves 86 the neodymium-iron material.

These curves indicate that with the rare earth magnet material 20 poles per inch might be appropriate for the image plate cylinder and 22 poles per inch for the blanket cylinder. With the neodymium-iron magnets 24 or even 26 poles per inch provide increased plate holding force intensity although the difficulty of manufacturing cylinders with magnets between 0.005 and 0.010 inch in width may outweighh the magnetic circuit advantages.

In the specification and claims, the magnetic circuit relationships are sometimes defined as maximizing a parameter, the peel-off resistance parameter, $$\frac{w_0}{k^{\frac{1}{2}}},$$

or the attractive force with nominal displacement. It will be understood from the foregoing discussion that the term maximize is used in the practical sense of optimizing the magnetic circuit components for cylinders, image plates and blanket carriers which may be manufactured from available components and used in printing, as with a high speed web offset press.

We claim:

1. A magnetic cylinder and plate of magnetic material for printing, in which the peripheral surface of the cylinder has alternate annular magnets and pole pieces, the magnets having a magnetic orientation axially of the cylinder, adjacent magnets being of opposite polarity, the magnets defining with the pole pieces a plurality of magnetic circuits, the plate being wrapped around the cylinder and completing the magnetic circuits between adjacent pole pieces, the plate being subject to edge peel-off from an outwardly directed force at the plate edge, the improvement that the magnetic circuits are characterized by:

a magnet width axially of the cylinder and a corresponding pole piece spacing axially of the cylinder to maximize the term $$\frac{w_0}{k^{\frac{1}{2}}}$$

where $w_0$ is the magnetic attractive force exerted on an area of the plate with no displacement between the plate and the cylinder surface and k is the magnitude of the slope of the linear portion of a plot of w, the magnetic attractive force exerted on the plate area as displacement of the plate area from the cylinder increases.

2. The magnetic cylinder and plate of claim 1 wherein said plate area is the plate edge.

3. The magnetic cylinder and plate of claim 1 in which $$k = \frac{w_0 - w}{y}$$

where w is the magnetic attractive force exerted on an area of the plate with a displacement y of the plate area from the cylinder surface.

4. The magnetic cylinder and plate of claim 1 in which the plate has a thickness of the order of 0.015", the pole pieces have an axial dimension of the order of 0.03", the magnetic material has an $H_r$ value of 2,200 Oersteds and a recoil permeability of 1.04, and the magnet width is of the order of 0.05".

5. The magnetic cylinder and plate of claim 1 in which the plate has a thickness of the order of 0.015", the pole pieces have an axial dimension of the order of 0.03", the magnetic material has an $H_r$ value of 5,600 Oersteds and a recoil permeability of 1.07, and the magnet width is of the order of 0.018".

6. The magnetic cylinder and plate of claim 1 in which the plate has a thickness of the order of 0.015", the pole pieces have an axial dimension of the order of 0.03", the magnetic material has an $H_r$ value of 9,800 Oersteds and a recoil permeability of 1.1, and the magnet width is of the order of 0.01".

7. The magnetic cylinder and plate of claim 1 in which the plate is precurved.

8. The magnetic cylinder and plate of claim 7 in which the radius of curvature of the plate is less than the radius of the cylinder.

9. The magnetic cylinder and plate of claim 8 in which $R_f$, the radius of curvature of the plate, is such that $$y_{MAX} = \frac{3}{512} \frac{Et^3}{(1-\nu^2)} \frac{1}{w}\left(\frac{1}{|R_f|} - \frac{1}{|R_c|}\right)^2$$

does not exceed about 50 microinches where $y_{MAX}$ is the maximum displacement along the displacement curve of the plate adjacent a leading or trailing edge.

E is Young's modulus for the plate material;

t is the plate thickness $\nu$ is Poisson's ratio;

$R_c$ is the cylinder radius.

10. The magnetic cylinder and plate of claim 7 in which only the ends of the plate are precurved.

11. The magnetic cylinder and plate of claim 10 in which the precurved length at each end of the plate is at least as great as the contactless length from the plate edge for the maximum resistance to an applied outward force, $P_{MAX}$.

12. The magnetic cylinder and plate of claim 11 in which the contactless length for $P_{MAX}$ is $$l_{MAX} = 1.875\left(\frac{Et^3}{12(1-\nu^2)k}\right)^{\frac{1}{4}}.$$

13. The magnetic cylinder and plate of claim 10 having a transition curve between the precurved plate ends and the uncurved center portion of the plate.

14. The magnetic cylinder and plate of claim 13 in which the length l of the transition curvature is at least $$l = \left(\frac{Et^3}{6w_0|R_c|(1-\nu^2)}\right)^{\frac{1}{2}}$$

where

E is Young's modulus;

t is plate thickness;

$R_c$ is the cylinder radius;

$\nu$ is Poisson's ratio.

15. The magnetic cylinder and plate of claim 1 for a magnetic material having an $H_r$ value of the order of 2,200 Oersteds in which the area ratio of the pole pieces to the magnets is of the order of 0.6.

16. The magnetic cylinder and plate of claim 1 for a magnetic material having an $H_r$ value of the order of 5,600 Oersteds in which the area ratio of the pole pieces to the magnets is of the order of from 1.8 to 2.4.

17. The magnetic cylinder and plate of claim 1 for a magnetic material having an $H_r$ value of the order of 9,800 Oersteds in which the area ratio of the pole pieces to the magnets is of the order of 3.3.

18. A magnetic cylinder and resilient blanket bonded to a carrier plate of magnetic material for offset web printing, in which the peripheral surface of the cylinder has alternate annular magnets and pole pieces, the magnets having a magnetic orientation axially of the cylinder, adjacent magnets being of opposite polarity, the magnet defining with the pole pieces a plurality of magnetic circuits, with the blanket and carrier plate being wrapped around the cylinder, the carrier plate completing the magnetic circuits between adjacent pole pieces, the carrier plate and blanket being susceptible to circumferential movement around the cylinder as the blanket is subjected to localized pressure from another cylinder in a nip, the improvement that the magnetic circuits are characterized by:

a magnet width axially of the cylinder and a corresponding pole piece spacing axially of the cylinder to maximize the attractive force exerted on the carrier plate with nominal displacement between the carrier plate and the cylinder surface.

19. The magnetic cylinder and blanket of claim 18 in which the condition of nominal displacement between the carrier plate and the cylinder surface represents a gap due to surface asperities and foreign matter, and plate separation from a mixmatch of the cylinder and carrier plate curvatures and the amplitude of a peripheral wave phenomenon in the blanket and carrier plate caused by nip forces on the blanket.

20. The magnetic cylinder and blanket of claim 18 in which the resilient blanket and carrier plate are precurved.

21. The magnetic cylinder and blanket of claim 20 in which the resilient blanket and carrier plate are a plurality of precurved segments.

22. The magnetic cylinder and blanket of claim 21 in which the resilient blanket and carrier plate comprise two 180° segments.

23. The magnetic cylinder and blanket of claim 21 in which the resilient blanket and carrier plate comprise four 90° segments.

24. The magnetic cylinder and offset blanket of claim 20 in which the blanket carrier plate is precurved with a radius less than the radius of the cylinder such that $$y_{MAX} = \frac{3}{512} \frac{Et^3}{(1-\nu^2)} \frac{1}{w}\left(\frac{1}{|R_f|} - \frac{1}{|R_c|}\right)^2$$

does not exceed 10 microinches where

E is Young's modulus;

t is the plate thickness;

$\nu$ is Poisson's ratio;

w is the magnetic attractive force per unit area;

$R_f$ is the precurve radius of the blanket support plate;

$R_c$ is the cylinder radius.

25. The magnetic cylinder and offset blanket of claim 18 for a magnetic material having an $H_r$ value of the order of 2,200 Oersteds in which the area ratio of the pole pieces to the magnets is of the order of from 1.0 to 1.4.

26. The magnetic cylinder and offset blanket of claim 18 for a magnetic material having an $H_r$ value of the order of 5,600 Oersteds in which the area ratio of the pole pieces to the magnets is of the order of from 1.8 to 3.0.

27. The magnetic cylinder and offset blanket of claim 18 for a magnetic material having an $H_r$ value of the order of 9,800 Oersteds in which the area ratio of the pole pieces to the magnets is of the order of 3.3.

* * * * *